United States Patent [19]

Moore et al.

[11] 4,236,770

[45] Dec. 2, 1980

[54] GLIDE INSERT FOR HANGING FILE FOLDER SYSTEM

[75] Inventors: David C. Moore, Aurora; Edward W. Cooper, Scarborough; Archibald Porteous, Willowdale, all of Canada

[73] Assignee: ACCO International Inc., Wheeling, Ill.

[21] Appl. No.: 30,320

[22] Filed: Apr. 16, 1979

[30] Foreign Application Priority Data

Apr. 26, 1978 [CA] Canada ..... 302031

[51] Int. Cl.[3] ..... A47B 63/00; B24F 13/06

[52] U.S. Cl. ..... 312/184

[58] Field of Search ..... 312/183, 184; 308/3 R, 308/3.6; 16/87 R, 90, 93 R, 93 D

[56] References Cited

U.S. PATENT DOCUMENTS

| | | | |
|---|---|---|---|
| 2,848,735 | 8/1958 | Ault et al. | 16/93 D |
| 3,255,758 | 6/1966 | Gauche | 312/184 |

FOREIGN PATENT DOCUMENTS

| | | | |
|---|---|---|---|
| 764224 | 8/1967 | Canada . | |
| 1446425 | 6/1966 | France | 312/184 |
| 1268161 | 2/1969 | United Kingdom . | |
| 1160740 | 8/1969 | United Kingdom . | |
| 1321277 | 11/1969 | United Kingdom . | |
| 1315887 | 5/1973 | United Kingdom . | |

*Primary Examiner*—Casmir A. Nunberg

*Attorney, Agent, or Firm*—Hume, Clement, Brinks, Willian & Olds, Ltd.

[57] ABSTRACT

The invention provides a device for insertion into the ends of hanging bars of file folder systems to reduce the friction and noise when those hanging bars are slid along the guide rails of filing cabinets. The device fits into the ends of the hanging bars and protrudes through the top edge of the hanging bars with pointed projections to inhibit the accidental withdrawal or dislodgement of the device from the hanger bar ends.

7 Claims, 7 Drawing Figures

GLIDE INSERT FOR HANGING FILE FOLDER SYSTEM

The invention relates to a plastic glide for insertion into hanging bars of file folder systems that provide for ease of sliding and reduction of noise and friction when the file folder hanging bars are moved and slid in cooperation with rails in filing cabinets, drawers or stands.

PRIOR ART

Hanger bars are used in cooperation with guide rails in file drawers for suspending file folder holders usually of cardboard and for facilitating the removal of file folders from such holding suspensions. The cooperation of the hanging bars with the rails of filing cabinets and the like have quite commonly incorporated inverted U-shaped notches in the ends of the bars whereby the bars may be retained on and override the rails by gravity. It is also well known prior art to incorporate within the inverted U-shaped notches plastic inserts which act as sound deadening elements to inhibit loud scraping noises that occur if the metallic hanging bars slide on metal rails. Other materials have been used for the glide inserts but the low friction properties of plastics have made them preferable.

A plastic hangar bar glide is illustrated in British Pat. No. 1,107,427 wherein the glide itself moves horizontally within the hanger bar. A further development of a plastic glide insert is illustrated in British Pat. No. 1,367,781. The plastic glide inserts of the type shown in British Pat. No. 1,367,781 are similar to the plastic inserts disclosed in British Pat. No. 1,315,887 which provides for the method of mass production of U-shaped plastic runners from a continuous extruded strip of the plastic runner material. This latter patent also illustrates the incorporation of one of the individual plastic runners into a hanger file folder.

THE INVENTION

Plastic guide runners as disclosed in the prior art and as indicated to be producible in the latter British patent have always been inserted individually into the file folder bars and these latter bars have generally consisted of an elongated metal strip folded along its longitudinal axis and the two sides of the fold clamped together to retain the upper edge of the cardboard holder. Prior to clamping the two sides of the fold, a plastic glide is inserted at each end of the bar between the sides of the fold and the glide is retained within the folded metal guide bar by mere clamping pressure, or additionally retained by crimping of the sides of the metal guide bar over a portion of the plastic insert, with or without deformation of the part of the plastic insert so clamped.

This invention provides for a more positive retention of such a plastic glide insert to prevent the accidental removal of the insert through use and wear or through manual abuse of the hanger bar.

The invention provides for a plastic glide insert which is positively retained between the two metal sides of the hanger bar by means of an elongated aperture through the fold of the metal hanger bar at each end of that bar and for the insertion of a portion of the plastic glide through the elongated aperture prior to clamping. The portion of the glide inserted through the elongated aperture inhibits or prohibits the removal of the insert from the clamped hanger bar by pointed projections outward from the glide beyond the ends of the aperture.

Because of the resilient nature of the plastic insert, the pointed portions of the insert projecting through the elongated aperture of the metal hanger bar are slightly wider than the length of the aperture. The insertion of the insert into the aperture of the hanger bar is accomplished by positively pressing the insert to force it through the aperture and the resilience of the plastic permits the two side projections of the insert to snap through the aperture and to snap back to a width greater than the length of the aperture, and thus prevent the withdrawal of the glide from the bar.

In a further embodiment of the invention, the portion of the plastic insert which projects through the elongated aperture of the hanger bar is in the form of two separate upwardly projecting legs. Each leg has, in the form of an upper foot, a smooth side adjacent the other leg of the insert and a hook-like projection on the opposite side. The hook-like projection has a flat lower edge on the bottom of the projection remote from the upper end of the leg and remote from the inner vertical edge of the leg. In its normal attitude, the distance between the hook-like projections of the two legs is greater than the length of the aperture. When inserting the inventive glide of this embodiment, the pressure to insert the two legs with projecting ends through the aperture of the hanger bar cause the two legs to press together and once the projections are through the aperture, the legs resiliently expand sideways and the projections bear against the metal at the ends of the elongated aperture, and thus prevent the withdrawal of the glide.

In a further embodiment of the invention, the same glide with the two upwardly projecting separate legs and outwardly projecting hook ends is employed and a further provision to prevent the withdrawal of the insert from the hanger bar is attained by a simple spot crimp through both thicknesses of the folded hanger bar metal directly in the space between the two upwardly projecting insert legs. That spot crimp serves to cause the two legs to move sideways away from each other, thereby causing their sideways projecting feet to positively expand to press the outer edges of the two legs against the ends of the aperture in the fold of the metal bar to positively retain the plastic glide within the folded sides of the metal hanger bar.

The provision of a spot crimp through the metal hanger bar can be made in the two sides of the folded metal bar prior to clamping the sides of the metal bar together, and even prior to the actual folding of the bar.

Thus, it is an object of the present invention to provide an improved glide for hanger bars for holder systems for file folders which improves the installation and retention of the inserts within the hanger bars of the system.

That object is attained by the invention which contemplates a plastic insert for hanger bars of file folder suspension systems which comprises a plate-like disc having a generally inverted U-shape. The inverted U-shaped disc has an upper base portion and two downwardly projecting leg portions, and the edges of the disc have thickening ridges around both sides of the disc and around the periphery of the U-shape. A leg projects upwardly from substantially the center of the upper base portion, and the projecting leg terminates in a crown. The crown has pointed projections at each side of the leg, and the pointed projections have bottom edges parallel to the base portion.

The features and operation characteristics of the inventive device are described hereafter in detail with reference to the illustrations of the invention in the following drawings.

Figure 1:
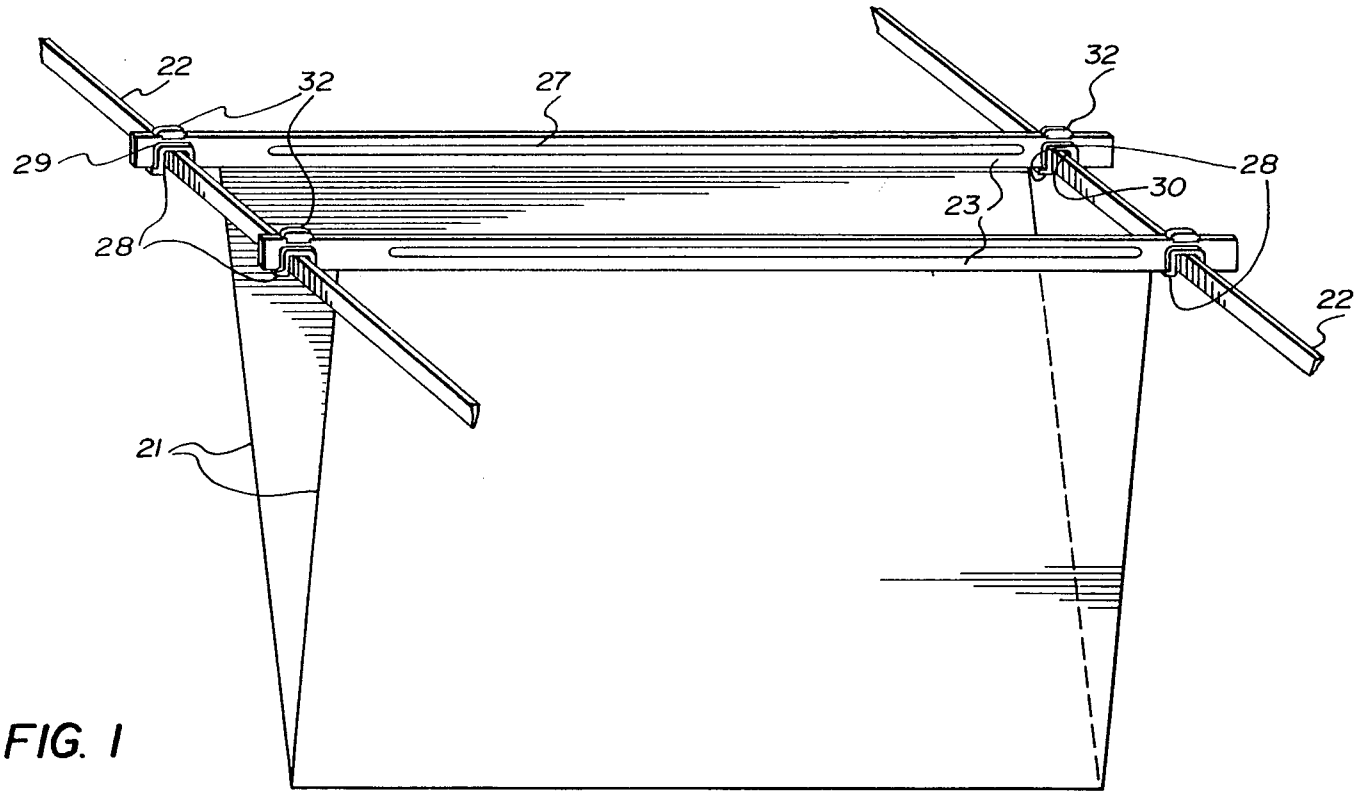
FIG. 1 is a perspective view of a file folder holder showing the inventive device installed in the ends of the hanger bars from which the holder is suspended.

As shown in FIG. 1 the plastic glides 28 are shown installed in inverted U-shaped notches 29 cut out of the ends of the hanger bars 23. The glides 28 are shown to have upwardly extending portions 32 which extend through and above the tops of hanger bars 23 and the glides 28 have bottom inverted U-shaped recesses 30 conforming to the notches 29. The hanger bars ride on rails 22 of a file cabinet or the like, and the cardboard holder 21 is suspended from the hanger bars 23 by a longitudinal crimping 27 for retaining the holder. Other means of suspending the holders 21 are well known in the art.

Figure 2:
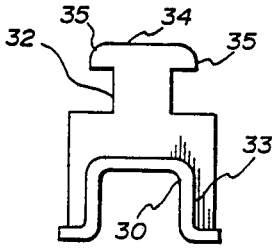
FIG. 2 is an elevational view of the plastic glide.
Figure 3:
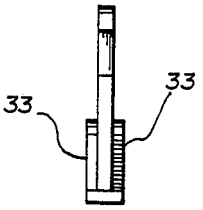
FIG. 3 is an end sectional view of the glide of FIG. 2.
Figure 4:
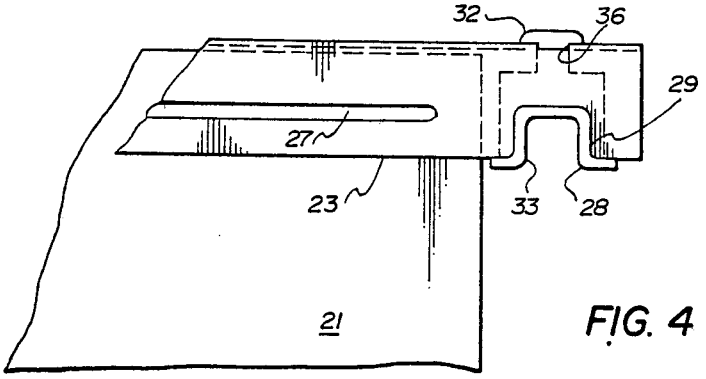
FIG. 4 illustrates the plastic glide of FIG. 2 installed in an end of a hanger bar.

FIGS. 2 and 3 are sectional views of the plastic glide wherein the inverted U-shaped recess 30 is shown to have its periphery 33 thickened on both sides of the plastic glide. At the end of the glide opposite recess 30 is projecting leg 32 which terminates in foot 34. Foot 34 has twin opposed pointed projections 35 and those projections have curved or tapering upper surfaces and flat lower surfaces. In FIG. 4 the glide 28 is shown installed in the notched end of hanger bar 23 with the recess 30 of the glide firmly seated against notch 29 and with the foot 34 of leg 32 projecting above the top edge of hanger bar 23. Hanger bar 23 is conventionally formed by longitudinally folding an elongated sheet metal member to have the sides of the hanger bar bear against holder 21 and retain the holder by a crimp 27, or the like. Prior to folding, an elongated aperture 36 is cut along the fold line of the sheet metal member and the length of that aperture is slightly less than the distance between the two pointed projections 35 of foot 34. The plastic of glide 28 has sufficient resiliency to permit the pointed projections 35 to deform and slide through the aperture 36 along the upper curved surfaces and, after passing through the apertures, the projections 35 snap back and the lower straight sections of projections 35 are retained against the upper metal folded edge of hanger bar 23, with the pointed projections extending beyond the ends of the aperture 36 to effectively retain the glide 28 between the two metal sides of the hanger bar 23 and inhibit the removal or dislodgement of the glide from the hanger bar.

Figure 5:
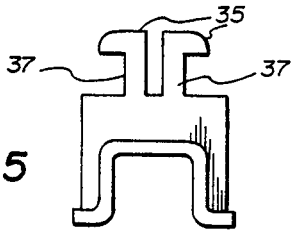
FIG. 5 is an elevational view of a preferred embodiment of the plastic glide.
Figure 7:
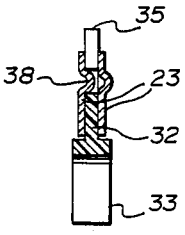
FIG. 7 is an enlarged cross sectional view of the installation of the plastic glide taken along sectional line 7—7 of FIG. 6.

A preferred embodiment of this inventive glide is shown in FIG. 5 wherein the leg 32 of FIG. 2 is shown to comprise two half-legs 37. The installation of the glide of FIG. 5 is shown in the end section of a hanger in FIG. 6. The space between half-legs 37 permit the half-legs to move together more easily when the two half-feet are being pressed through the aperture 36 of the upper leg of the hanger bar 23 so that the pointed projections 35 can pass through the aperture 36 with the application of less force than is required to project the foot 34 through the aperture as illustrated in FIG. 4. The resiliency of the half-legs 37 cause them to spring back to their original positions and the bottom straight edges of projections 35 bear against the upper edge of the folded hanger bar beyond the ends of the apertures and thus retain the glide in the same manner as mentioned with respect to FIG. 4.

Figure 6:
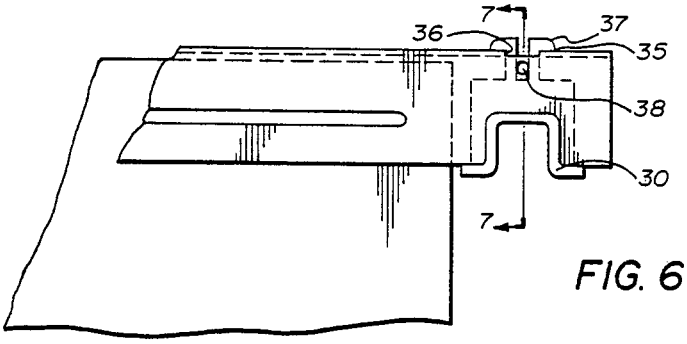
FIG. 6 illustrates the plastic glide of FIG. 5 installed in an end of a hanger bar.

At 38 in FIG. 6 is shown a further preferred embodiment of the installed inventive device wherein a spot crimp in the two sides of the metal hanger bar is shown to be located exactly between the two half-legs 37. This spot crimp serves to force the half-legs 37 apart and thus make more positive the extension of pointed projections 35 beyond the ends of aperture 36.

The spot crimp 38 can be preformed in the two sides of the metal plate to be folded to form hanger bar 23, in which case the spot crimps match together and take effect when the sides of the hanger bar are crimped along 27 over the cardboard holder 21.

Alternately, the spot crimp can be formed by a separate pressing or crimping step taken after the glide has been inserted through the aperture and between the two folded sides of the hanger bar. Further, this spot crimping step can be taken simultaneously with the crimping step taken to fasten the holder 21 between the two sides of the hanger bar 23, and thus effectively spread the half-legs 37 to force the legs against the ends of the aperture 36 and project the projections 35 beyond those aperture ends.

It is understood that the foregoing disclosure relates to descriptions of specific embodiments of the invention, and that numerous modifications or alterations may be made without departing from the true spirit and scope of the invention as set forth in the appended claims.

The embodiments of the invention in which an exclusive property or privilege is claimed are defined as follows:

1. A plastic insert for hanger bars of file folder suspension systems which hanger bars include an elongated slit aperture adjacent each end, said plastic insert comprising:

a plate-like disc having a generally inverted U-shape, said disc having an upper base portion and two downwardly projecting leg portions, the edges of said disc having thickening ridges around the periphery of said U-shape;

a leg projecting upwardly from substantially the center of said upper base portion, said upwardly projecting leg terminating in a crown with said crown having projections at each side of said leg, said projections having bottom edges parallel to said base portion;

said upwardly projecting leg being adapted to be inserted through the aperture in the hanger bar and to retain said plastic insert in position with respect to the hanger bar.

2. A plastic insert as defined in claim 1 wherein said upwardly projecting leg comprises two spaced-apart half-legs, each said half-leg having an inside edge and an outside edge, and wherein said crown comprises two half-crowns with each said half-crown having as an inside edge an extension of said inside edge of one of said half-legs, and said half-crowns having said projections as outside edges.

3. An elongated hanger bar for a file folder suspension system, said bar comprising:

two side portions;

a substantially closed top edge; and an open bottom edge, wherein each end of said bar has a recess in said bottom edge of said bar and wherein each end of said bar has an elongated slit aperture cut in said top closed edge of said bar;

a pair of plastic inserts, each of said inserts including a plate-like disc having a generally inverted U-shape, said disc having an upper base portion and two downwardly projecting leg portions, the edges of said disc having thickening ridges around the periphery of said U-shape, a leg projecting upwardly from substantially the center of said upper base portion, said upwardly projecting leg terminating in a crown with said crown having projections at each side of said leg, said projections having bottom edges parallel to said base portion, with one of said plastic inserts located within each said recess and between said two side portions of said bar, and said crown of said upwardly projecting leg of said insert projecting through said elongated slit aperture, said aperture having a length approximately equal to or slightly greater than the width of said leg, said bottom edges of said projections located above and adjacent to said closed top edge of said bar, and said projections extending beyond the ends of said aperture.

4. The elongated hanger bar of claim 3 wherein said upwardly projecting leg of said plastic insert comprises two spaced-apart half-legs, each said half-leg having an inside edge and an outside edge, and wherein said crown comprises two half-crowns with each said half-crown having as an inside edge an extension of said inside edge of one of said half-legs, and said half-crowns having said projections as outside edges, said projections having bottom edges parallel to said base portion.

5. An elongated hanger bar as claimed in claim 4 wherein said two side portions of said bar are spot crimped together at each end of said bar, each of said spot crimps being located below said top edge of said bar, above said recess, and between said half-legs.

6. The plastic insert of claim 1 wherein said projections of said crown extend beyond the ends of the aperture when said plastic insert is in position in the hanger bar.

7. The plastic insert of claim 2 wherein the distance between the remote ends of said projections is greater than the length of the aperture in the hanger bar.

* * * * *